US006929421B2

(12) United States Patent
Potts et al.

(10) Patent No.: US 6,929,421 B2
(45) Date of Patent: Aug. 16, 2005

(54) VIBRATORY MECHANISM AND METHOD FOR LUBRICATING THE SAME

(75) Inventors: Dean R. Potts, Maple Grove, MN (US); Federico B. Rio, Minneapolis, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 10/327,596

(22) Filed: Dec. 20, 2002

(65) Prior Publication Data

US 2004/0120767 A1 Jun. 24, 2004

(51) Int. Cl.[7] ..... E01C 19/28
(52) U.S. Cl. ..... 404/117; 404/122; 74/61
(58) Field of Search ..... 404/117, 122, 404/132; 74/86, 87, 61

(56) References Cited

U.S. PATENT DOCUMENTS

| | | | | | |
|---|---|---|---|---|---|
| 1,061,142 | A | | 5/1913 | Tesla | |
| 3,650,582 | A | * | 3/1972 | Casey | 384/134 |
| 3,948,354 | A | * | 4/1976 | Fosse et al. | 184/6.22 |
| 3,954,309 | A | * | 5/1976 | Hutson et al. | 384/114 |
| 4,111,081 | A | * | 9/1978 | Hubert | 74/61 |
| 4,387,539 | A | * | 6/1983 | Fewel | 451/327 |
| 6,007,273 | A | | 12/1999 | Magee | |
| 6,551,020 | B2 | * | 4/2003 | Swanson et al. | 404/117 |
| 6,561,729 | B1 | * | 5/2003 | Potts | 404/117 |
| 2003/0021629 | A1 | * | 1/2003 | Swanson et al. | 404/117 |
| 2003/0079559 | A1 | * | 5/2003 | Potts | 74/87 |
| 2003/0082001 | A1 | * | 5/2003 | Potts | 404/117 |
| 2003/0082002 | A1 | * | 5/2003 | Potts | 404/117 |
| 2003/0082003 | A1 | * | 5/2003 | Potts | 404/117 |

* cited by examiner

*Primary Examiner*—Robert E. Pezzuto
*Assistant Examiner*—Alexandra Pechhold
(74) *Attorney, Agent, or Firm*—Jeffrey A Greene; Kevin C Earle

(57) ABSTRACT

A vibratory mechanism is provided for a compacting work machine. The vibratory mechanism includes at least one eccentric weight rotatably positioned within a housing. Pressurized fluid is introduced into the vibratory mechanism at an inlet passage. A means for moving fluid through the vibratory mechanism and lubricating a pair of bearings is provided that operates during rotation of the eccentric weight.

10 Claims, 4 Drawing Sheets

VIBRATORY MECHANISM AND METHOD FOR LUBRICATING THE SAME

TECHNICAL FIELD

The present invention relates generally to a lubrication system for a compacting work machine, and more particularly to a lubrication system for a vibratory mechanism of such a machine.

BACKGROUND

Compacting work machines are supported on one or more rotating drums that are used to roll over and compact stratums such as soil, aggregates and asphalt mixtures during the construction of roadways, parking lots and buildings. The rotating drums include one or more vibratory mechanisms mounted within the rotating drum to increase the compacting force during operation. The vibratory mechanisms include an eccentric weight that is supported by a bearing arrangement inside a pod or self-contained housing. The eccentric weight is rotated causing the drum to vibrate, thus increasing the efficiency in which the material, the drum is rolled over is compacted.

During operation the bearing arrangement becomes very hot as the eccentric weight is rotated thereon. The heat can reach relatively high temperatures that can cause damage to the bearing arrangement, which increases the maintenance cost of the work machine. Some drum assembly designs depend upon the heat being conducted away from the bearing assembly through the various components of the drum assembly surrounding the vibratory pod mechanism. However, this approach is relatively inefficient and under certain conditions still allows the bearing assembly to overheat. One approach to solving this problem, which has substantially helped to dissipate the heat of the vibratory pod mechanism, is disclosed in U.S. Pat. No. 6,007,273 issued Dec. 28, 1999 to Kevin Magee and assigned to the owner of the present application. This design simply uses paddle arrangements positioned on the inner diameter of the drum assembly. As the machine traverses a work sight the paddles pick up coolant contained within the drum cavity and deposit the coolant on the exterior of a vibratory pod mechanism.

The present invention is directed to overcome one or more of the problems as set forth above.

SUMMARY OF THE INVENTION

In one aspect of the present invention a vibratory mechanism is provided. The vibratory mechanism comprises a housing in which at least one eccentric weight is positioned and is rotatably supported by a pair of bearings. An inlet passage is in fluid connection with a supply of pressurized fluid and a cavity within the housing. A pump is connected with the housing and being in fluid communication with the pair of bearings.

In yet another aspect of the present invention a method of lubricating a vibratory mechanism is provided. The method comprises supplying lubricating fluid to the vibratory mechanism. Rotating an eccentric weight within the vibratory mechanism so as to move the lubricating fluid through the vibratory mechanism. Depositing lubricating fluid on a pair of bearings that support the eccentric weight of the vibratory mechanism.

DETAILED DESCRIPTION

Figure 1:
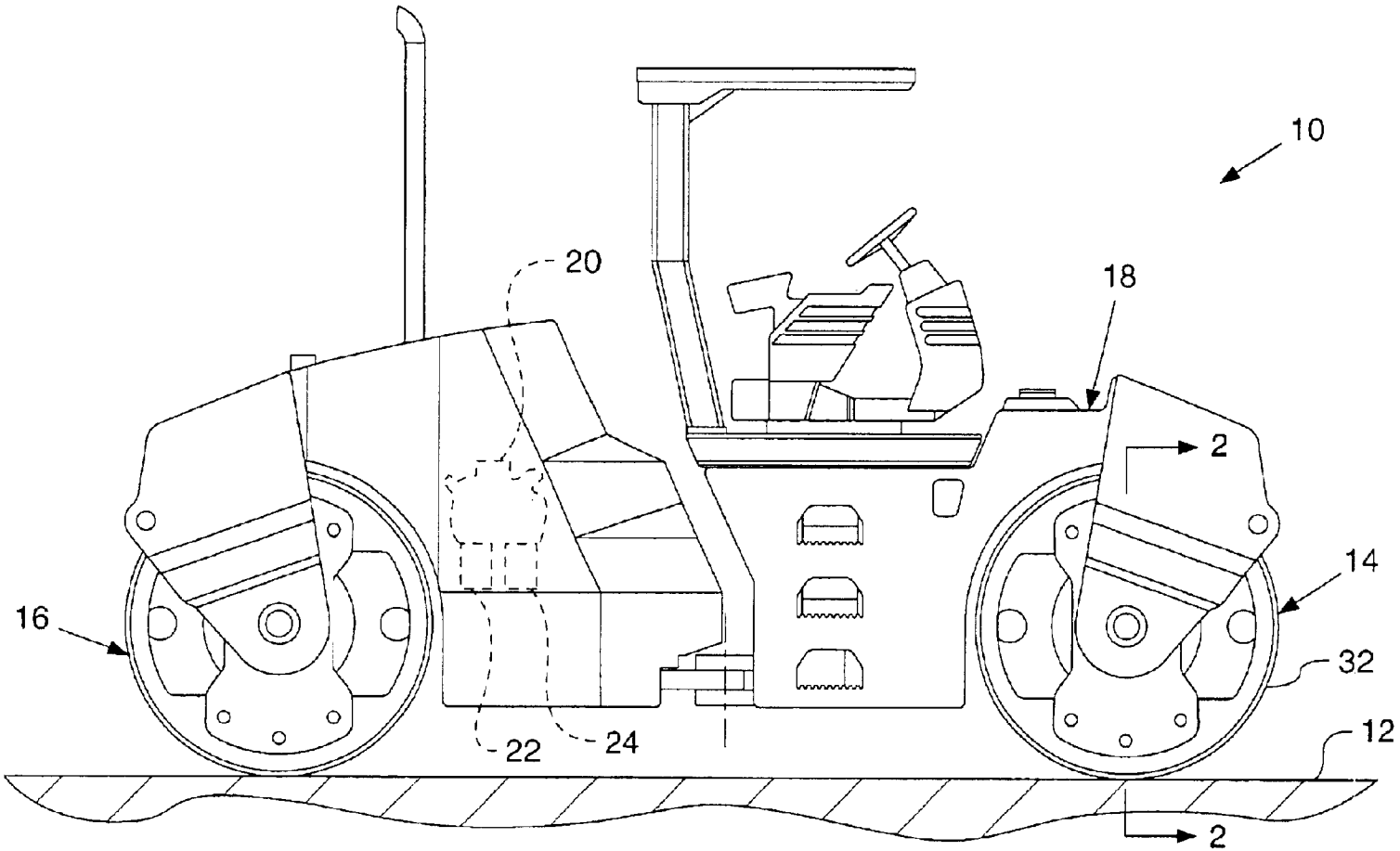
FIG. 1 is a side elevational view of a work machine embodying the present invention.

A work machine 10 for increasing the density of a compactable material 12 such as soil, gravel, or bituminous mixtures an example of which is shown in FIG. 1. The work machine 10 shown is for example, a double drum vibratory compactor, having a first/front compacting drum 14 and a second/rear compacting drum 16 rotatably mounted on a main frame 18. However, the description applies equally as well to a work machine 10 having only a single compacting drum 14. The main frame 18 also supports an engine 20 that has a first fluid pump 22 and a second fluid pump 24 conventionally connected thereto.

Figure 2:
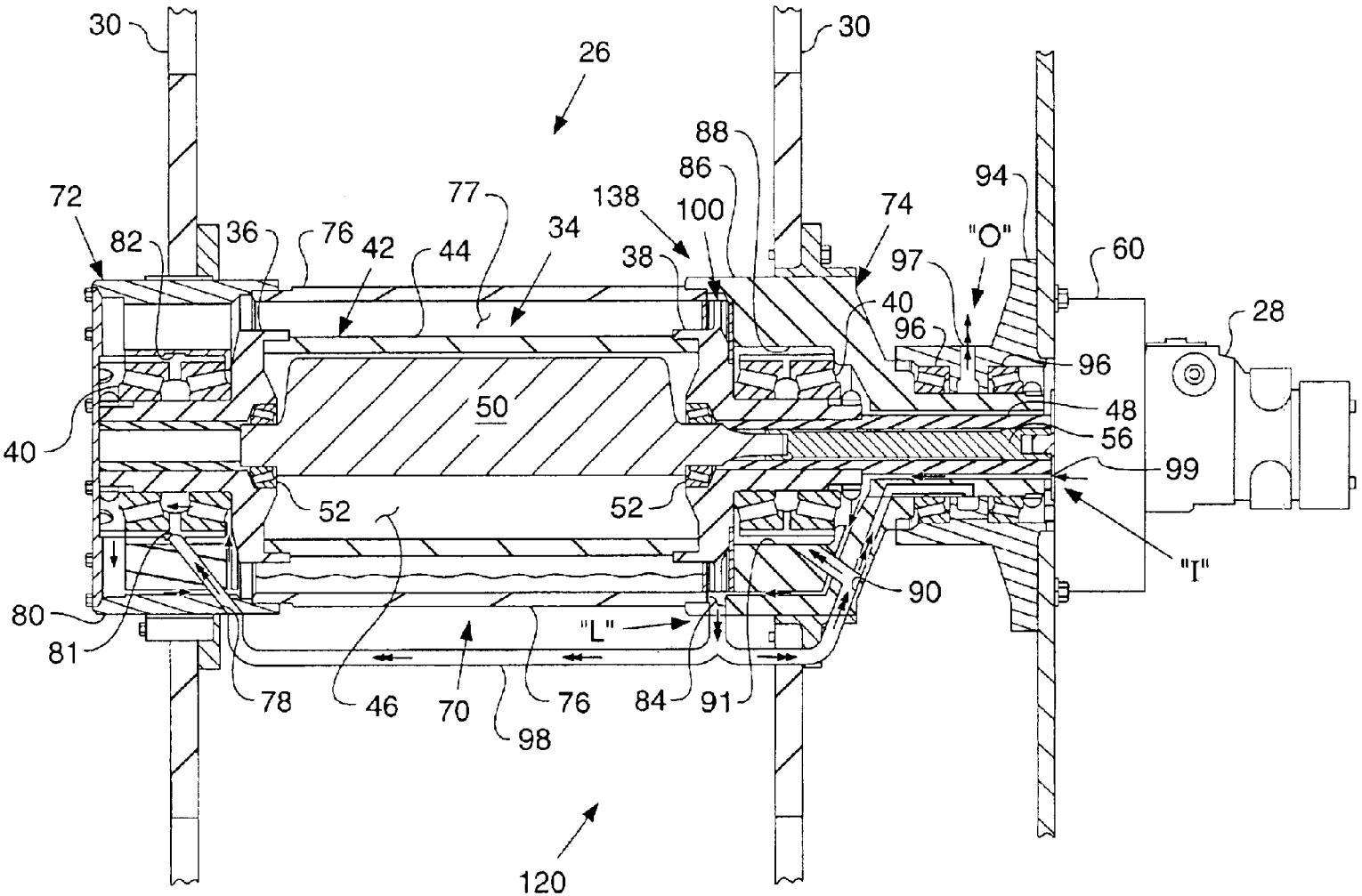
FIG. 2 shows an axial cross section view taken along line 2—2 through a rolling drum of the compacting machine of FIG. 1 embodying the present invention.
Figure 4:
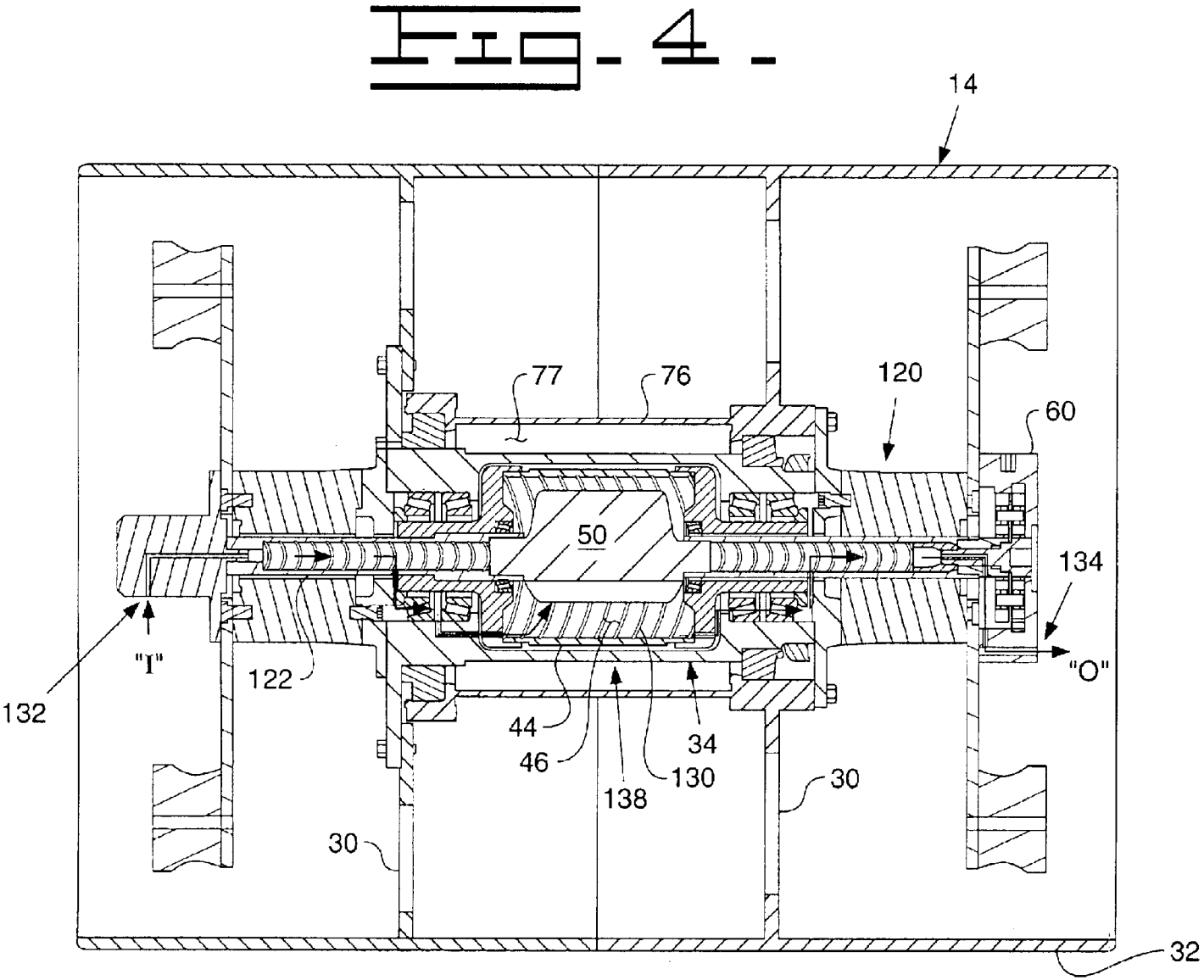
FIG. 4 is an alternate embodiment for the vibratory pod mechanism shown in FIG. 2.

Since the first drum 14 and the second drum 16 are structurally and functionally similar only the first drum 14 will be discussed in detail and applies equally to the second drum 16. Referring now to FIG. 2, the first drum 14 includes at least one vibratory mechanism 26 that is operatively connected to a fluid motor 28. Vibratory mechanism 26 is supported by a pair of bulkheads 30 that are connected, as by welding, to an outer drum shell 32 (drum shell 32 is shown in FIGS. 1 and 4). A first eccentric weight 34 includes a first stub shaft 36 and a second stub shaft 38 that are rotatably supported by a pair of bearings 40. The first and second stub shafts 36,38 have an annular member 42 positioned there between. Annular member 42 includes an eccentric lobe 44 that forms a cavity 46 between the first and second stub shafts 36,38. The second stub shaft 38 is drivingly connected to fluid motor 28 by an input shaft 48, as by splines or drive couplings (not shown).

Positioned within the cavity 46 is a second eccentric weight 50 that is rotatably supported by a pair of bearings 52. The bearings 52 are located in counter bores 54 concentrically formed in the first and second stub shafts 36,38 inwardly facing cavity 46. The second eccentric weight 50 is attached to a shaft 56, coaxially rotatably positioned within input shaft 48. Shaft 56 is similarly concentrically drivingly connected to fluid motor 28, as by splines or drive couplings (not shown). Pressurized fluid is supplied to the fluid motor 28, through fluid conduits and control valves (not shown), from the first fluid pump 22 for supplying rotational power to the vibratory mechanism 26 thereby imparting a vibratory force on the compacting drum 14.

More specifically as shown, a gearbox 60 is positioned between fluid motor 28 and the vibratory mechanism 26 to vary the phase angle between the second eccentric weight 50 and the first eccentric weight 34. However, it should be understood that other arrangements may be used, in place of the gearbox 60, to vary the phase relationship between the second eccentric 50 and the inner eccentric 34 without departing from the gist of the present disclosure. For example, a slip clutch, a handle wheel or other arrangement (none of which are shown).

In the example shown in FIG. 2 and described above, a second eccentric weight 50 is positioned within a first eccentric weight 34 so that the phase angle between the weights can be shifted relative to one another to vary the vibratory force imparted on the compacting drum 14. However, the first eccentric weight 34 alone may used to impart a vibratory force, with fixed amplitude, on the compacting drum 14 and still be within the gist of the present description.

Still referring to FIG. 2, the vibratory mechanism 26 is shown positioned within in a housing 70. Housing 70 includes a first end portion 72, a second end portion 74 and an annular center portion 76. The first end portion 72, second end portion 74 and the annular center portion 76 form a cavity 77 therebetween. The first end portion 72 is secured to one of the bulkheads 30 and supports the first stub shaft 36 of the first eccentric weight 34.

A passage 78 extends from an outer surface 80 to a bearing receiving portion 81 of an inner surface 82 of the first end portion 72. The annular center portion 76 is sealingly received by the first end portion 72 and the second end portion 74 and extends axially concentrically about the first eccentric weight 34. The second end portion 72 is connected to the other of the bulkheads 30 and supports the second stub shaft 38 of the first eccentric weight 34. An outlet passage 84, designated at "L", extends from an outer surface 86 to an inner surface 88 adjacent to the annular center portion 76. An inlet passage 90 extends from the outer surface 86 to a bearing receiving portion 91 of the inner surface 88 of the second end portion 74. The inlet passage 90 also branches off and extends to the inner surface 88 adjacent to the input shaft 48. A trumpet housing 94 having a pair of bearings 96 positioned therein is disposed about the second end portion 74 distal from the annular center portion 76. An outlet port 97, designated by "O" is located in the trumpet housing 94 between the pair of bearings 96. A conduit 98 connects the inlet passage 90 to the outlet passage 84 of the second end portion 74 and the passage 78 of the first end portion 72. A fluid inlet 99 is positioned between the input shaft 48 and the second end portion 72 of the housing 70 and is connected to a supply of pressurized fluid, designated by "I". The supply of pressurized fluid can come from a variety of sources, for example a stand alone system (not shown), a portion of the pressurized fluid branched off from the supply to fluid motor 28, or a flush supply (not shown) used to cool fluid motor 28.

Figure 3:
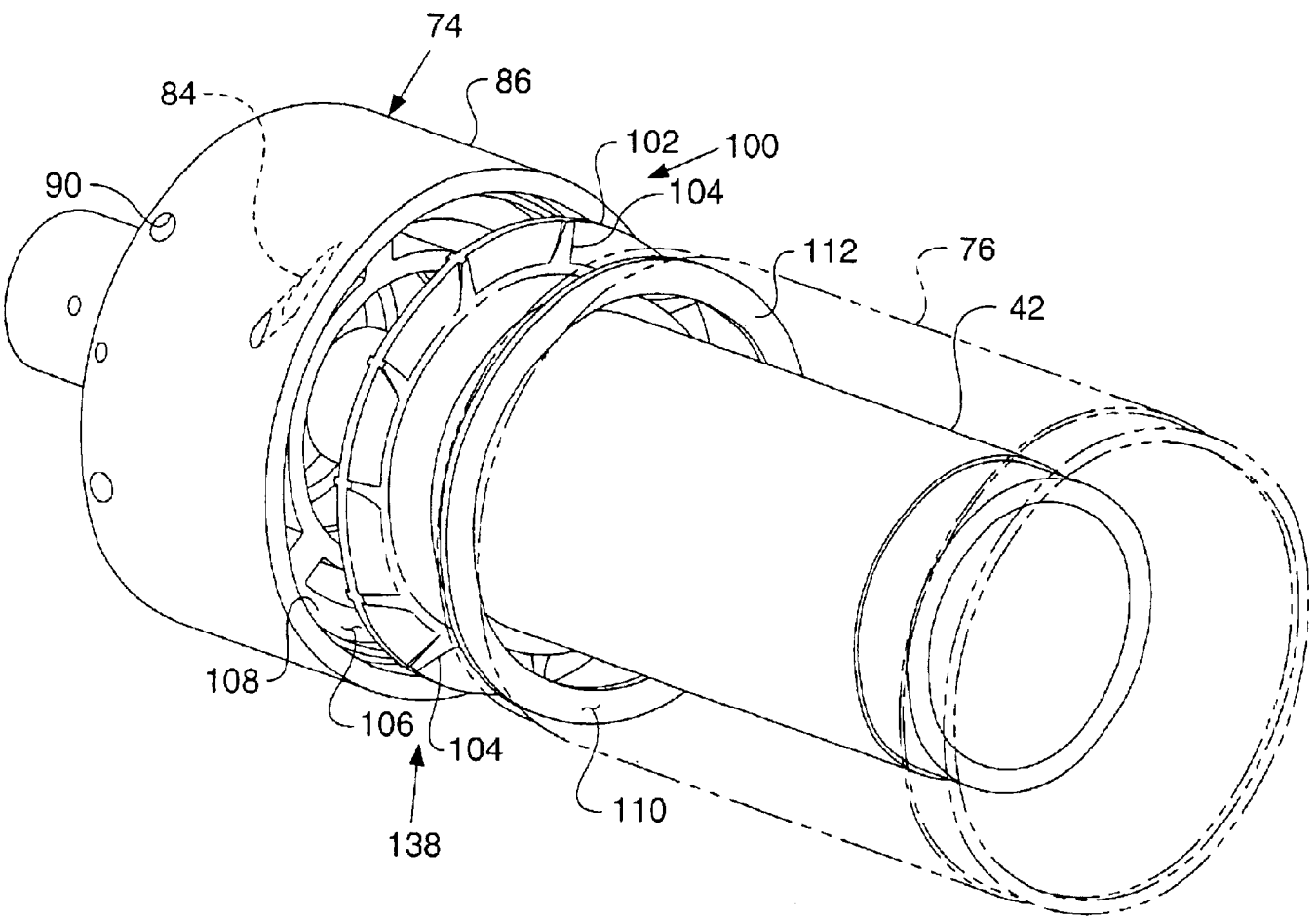
FIG. 3 is an isometric view of vibratory pod mechanism of FIG. 2.

With reference to FIG. 3, positioned between the second end portion 74 and the annular center portion 76 is a means 138 for moving fluid. In this example the means 138 is a pump 100. A rotor 102 extends radially outward from the second stub shaft 38 of the first eccentric weight 34. The rotor 102 has a plurality of fluid pressurizing protrusions 104 positioned on both sides thereof. A radial shoulder 106 of the second end portion 74 forms a stator 108 that is located adjacent the rotor 102 in and assembled state. The annular center member 76 includes a ring member 110 forming a second stator 112 located adjacent the rotor 102 when assembled. The pump 100 is shown and described as being a centrifugal type pump however, it should be understood that other types of pumps may be used such as a tesla or vane pump.

Referring now to FIG. 4 and alternate embodiment of the fluid moving means 138 for the vibratory mechanism 26 is shown with similar components having like reference numbers. Fluid motor 28 is shown connected to on the opposite side of the vibratory mechanism 26. A hollow shaft 122 connects fluid motor 28 to the first eccentric weight 34 and the second eccentric weight 50. Specifically, hollow shaft 122 is drivingly connected to one end of the first eccentric weight 34 and rotatably supports one end of the second eccentric weight 50. The opposite end of the first eccentric weight 34 is connected to a second hollow shaft 124 that is connected to the gear box 60. A solid shaft 128 concentric with the second hollow shaft 124 is drivingly connected between the gear box 60 and the second eccentric weight 50. A helix or groove 130 is located internally in the first and second hollow shafts 122,124 and the annular member 42 of the eccentric weight 26. Fluid motor 28 includes a hollow output 132 and the gear box 60 includes an outlet passage 134.

INDUSTRIAL APPLICABILITY

During a given compacting operation, pressurized fluid is supplied to the fluid motor 28 to rotate at least one of the eccentric weights 34 to impart a force on the compacting drum 14 as the work machine 10 traverses a respective compactable material 12. The rotation of the eccentric weight 34 of the vibratory mechanism 26 causes the pair of bearings 40 to generate heat. This heat can be quit high at times and can lead to premature failure of the bearings 40 and other surrounding components.

The vibratory mechanism 26 detailed in FIGS. 2 and 3 elevates the heat build up and purges contaminants from the housing 70 and operates in the following manner. Pressurized fluid is introduced between the input shaft 48 and the second end portion 74, shown at "I" by the single arrowheads, in a known manner such as fittings or conduits not shown. The fluid flows between the input shaft 48 and the second end portion 74 into the cavity 77 of the housing 70. When the first eccentric weight 34 of the vibratory mechanism 26 the fluid moving means 138 is rotated and moves fluid to the pair of bearings 40. In the embodiment disclosed in FIGS. 2 and 3 the means includes pump 100. The pressurizing protrusions 104 on the rotor 102 pick up and pressurize the fluid in the cavity 77. Fluid is directed to the outlet passage 84, as indicated by the double arrowheads at "L", of the second end portion 74 of the housing 70 and into conduit 98. The flow of fluid is divided in conduit 98 and a portion is directed to the passage 78 of the first end portion 72 to one of the pair of bearings 40 and the other portion is directed to the inlet passage 90 to the other of the pair of bearings 40. A portion of the fluid within the inlet passage 90 is also directed to the pair of bearings 96 between the trumpet housing 94 and the second end portion 74. A portion of the fluid is discharged from the trumpet housing 94 as indicated by the triple arrowheads at "O" and drained back to a reservoir (not shown). Thus, the vibratory mechanism 26 is supplied with a cooled and filtered fluid. The vibratory mechanism 26 utilizes a pump 100 that can operate for long periods of time when the cavity 77 is void of fluid.

In the alternate embodiment of the vibratory mechanism 26 shown in FIG. 4, fluid enters at fluid motor 28 indicated by the single arrowheads designated at "I". Fluid enters the hollow shaft 122 and the fluid moving means 138 advances fluid to the cavity 77. In this embodiment the means 138 is a helical groove/ridge or helix 130 that pulls the fluid towards the cavity 46 of the first eccentric weight 34 by the helix 130 during operation of the vibratory mechanism 26. Fluid is deposited on one of the pair of bearings 40 as it moves through the hollow shaft 122. Once the fluid enters the cavity 46 the helix 130 in the annular member 42 it is pulled through and forced to the other of the pair of bearings 40. The helix 130 in the second hollow shaft 124 pulls the fluid through to the gear box 60 where it is discharged through the outlet passage 134 indicated by the single arrowheads at "O".

What is claimed is:

1. A vibratory mechanism comprising:

a housing forming a cavity;

at least one eccentric weight positioned within said housing and being rotatably supported by a pair of bearings;

an inlet passage being in fluid connection with a supply of pressurized fluid and the cavity within said housing; and a pump being independent from the supply of pressurized fluid, said pump being connected with said housing and being operably connected with the rotatable eccentric weight, said pump operable to receive the supply of pressurized fluid and communicate the fluid to said pair of bearings.

2. The vibratory mechanism of claim 1, wherein said pump is positioned within said housing.

3. The vibratory mechanism of claim 2, wherein said pump includes a rotor and a pair of stators.

4. The vibratory mechanism of claim 3, wherein said rotor is connected to said eccentric weight and rotates therewith.

5. The vibratory mechanism of claim 1, wherein said inlet passage is positioned between a second end portion of said housing and an input shaft of said eccentric weight.

6. The vibratory mechanism of claim 1, wherein said pump is in fluid connection with an outlet port.

7. A vibratory mechanism for a work machine comprising:

a housing;

at least one eccentric weight concentrically positioned within said housing and being rotatably supported by a pair of bearings;

an inlet passage being in fluid connection with a supply of pressurized fluid; and a fluid moving means being independent from the supply of pressurized fluid, said fluid moving means being operably connected to the rotatable eccentric weight and being operable to receive the supply of fluid from said inlet passage and communicate the fluid to said pair of bearings, said fluid moving means includes a pump being connected with said housing, said pump being positioned within said housing and includes a rotor and a pair or stators, said rotor being connected to said eccentric weight and rotates therewith, said stators being connected to said housing.

8. A vibratory mechanism for a work machine comprising:

a housing;

at least one eccentric weight concentrically positioned within said housing and being rotatably supported by a pair of bearings;

an inlet passage being in fluid connection with a supply of pressurized fluid; and a fluid moving means being independent from the supply of pressurized fluid, said fluid moving means including a helix, said fluid moving means being operably connected to the rotatable eccentric weight and being operable to receive the supply of fluid from said inlet passage and communicate the fluid to said pair of bearings.

9. A method of lubricating a vibratory mechanism comprising:

supplying lubricating fluid to the vibratory mechanism;

rotating an eccentric weight within the vibratory mechanism so as to move the lubricating fluid through the vibratory mechanism, the eccentric weight operably connected to a fluid moving means;

wherein said rotating of the eccentric weight allows depositing of lubricating fluid to a pair of bearings that support the eccentric weight of the vibratory mechanism; and wherein rotating the eccentric weight pulls the lubricating fluid through the vibratory mechanism by way of a helical groove.

10. A method of lubricating a vibratory mechanism comprising:

supplying lubricating fluid to the vibratory mechanism;

rotating an eccentric weight within the vibratory mechanism so as to move the lubricating fluid through the vibratory mechanism, the eccentric weight operably connected to a fluid moving means;

wherein said rotating of the eccentric weight allows depositing of lubricating fluid to a pair of bearings that support the eccentric weight of the vibratory mechanism; and wherein rotating the eccentric weight pressurizes the lubricating fluid by way of a pump attached to the eccentric weight.

* * * * *